United States Patent [19]

Carlson et al.

[11] Patent Number: 4,677,895

[45] **Date of Patent: * Jul. 7, 1987**

[54] MULTIPLE RAIL ELECTROMAGNETIC LAUNCHERS WITH ACCELERATION ENHANCING RAIL CONFIGURATIONS

[75] Inventors: Richard J. Carlson, Santa Clara, Calif.; George A. Kemeny, Wilkins Township, Allegheny County, Pa.

[73] Assignee: Westinghouse Electric Corp., Pittsburgh, Pa.

[ * ] Notice: The portion of the term of this patent subsequent to Sep. 2, 2003 has been disclaimed.

[21] Appl. No.: 717,993

[22] Filed: Mar. 29, 1985

[51] Int. Cl.[4] ..... F41F 1/02

[52] U.S. Cl. ..... 89/8; 124/3; 310/12

[58] Field of Search ..... 89/8; 124/3; 310/12-14; 336/223, 70, 105, 107, 116, 150, 145-147, 150, 142; 318/135; 323/268, 267, 269, 272

[56] References Cited

U.S. PATENT DOCUMENTS

| | | | |
|---|---|---|---|
| 3,796,890 | 3/1974 | Thompson et al. | 323/267 X |
| 4,319,168 | 3/1982 | Kemeny | 89/8 |
| 4,347,463 | 8/1982 | Kemeny et al. | 310/13 X |
| 4,480,523 | 11/1984 | Young et al. | 89/8 |
| 4,485,720 | 12/1984 | Kememy | 89/8 |
| 4,577,545 | 3/1986 | Kemeny | 89/8 |
| 4,608,908 | 9/1986 | Carlson et al. | 124/3 X |

*Primary Examiner*—Deborah L. Kyle
*Assistant Examiner*—John E. Griffiths
*Attorney, Agent, or Firm*—R. P. Lenart

[57] ABSTRACT

An internally augmented, parallel rail electromagnetic projectile launching system includes a plurality of projectile launching rail pairs wherein the stacked height of the rails adjacent to the launcher bore decreases from the breech end to the muzzle end of the launcher. The launcher rail pairs may be electrically connected in series with each other and in series with an external current source. Alternatively, a separate though not necessarily entirely independent current source may be provided for each pair of rails and switching means may be included to substantially simultaneously connect each current source to its associated rail pair.

9 Claims, 11 Drawing Figures

MULTIPLE RAIL ELECTROMAGNETIC LAUNCHERS WITH ACCELERATION ENHANCING RAIL CONFIGURATIONS

BACKGROUND OF THE INVENTION

This invention relates to electromagnetic projectile launchers and more particularly to such launchers which utilize projectile launching rails having controlled cross sectional shapes to improve projectile accelerating forces.

Parallel rail electromagnetic launchers which utilize a single pair of projectile rails require very high currents to achieve projectile velocities in excess of those obtained with conventional accelerating means such as explosives. In order to achieve a given accelerating force with a lower current, various augmentation schemes have been proposed. External augmentation is accomplished by placing additional conductors outside of the bore to increase bore flux and thereby increase the force exerted for a given current level on the armature, or on a sabot by a plasma. Internally augmented launchers have additional conductors disposed along the interior of the bore. For a given number of conductor pairs, internal series augmentation results in the highest force increase for a given current or yields the greatest current reduction for a given propelling force compared to a simple parallel rail launcher. Thus internal series augmentation is highly desirable from high propellant force and current reduction considerations. However, when the rail pairs in an internally augmented launcher are electrically connected in series, the integrity of the individual rail and armature current loops must be maintained since failure to do so will result in shorting out loops which will cause a drastic reduction in the projectile accelerating force. Because of high velocities and high currents, relatively high voltage differences exist between adjacent rails and adjacent but distinct current paths across the armature. Therefore, successful operation of internally series augmented launcher configurations is most likely to be attained for lower velocity, large bore massive projectile applications involving current conducting armatures or specially constructed sabots for plasma separation. A commonly assigned, copending application Ser. No. 381,603, filed May 24, 1982 and entitled "Parallel Rail Electromagnetic Launchér With Multiple Current Path Armature", U.S. Pat. No. 4,485,720 discloses series connected internally augmented launchers with plasma separating sabots and is hereby incorporated by reference.

The potential difference between adjacent conductors in an internally augmented launcher can be minimized through the use of multiple sources of current wherein each pair of conductors and the associated conductive armature path or plasma are supplied by an independent current source. If current is supplied by individual and presumably identical current sources to each of a number of physically in parallel projectile rail pairs, then the total current for this rail configuration is roughly, for the same overall configuration, current density and acceleration, identical to the current for a simple parallel rail launcher. Internally augmented launchers having multiple current sources are also disclosed in the above U.S. Pat. No. 4,485,720.

In a parallel rail electromagnetic launcher, a force accelerates a current carrying conductor located in a magnetic field and this force is equal to the vector cross product of the current density and the magnetic flux density. It can be shown that this force is equal to $\frac{1}{2} L'I^2$ where $L'$ is the inductance gradient of the parallel rail configuration and I is the current. The magnetic field, which interacts with and therefore accelerates a current carrying conducting armature or plasma, is primarily produced by the conducting rails just in the wake of the armature. For example, the magnetic field is produced by the time dependent current distribution which exists in the rails not more than roughly three bore widths behind the armature. The accelerating force is similarly a function of that instantaneous current distribution in the conducting rails right in the vicinity of the armature or driving plasma. Therefore it should be understood that the significant value of $L'$ is the inductance gradient existing in the current conducting rails right behind or in the close vicinity of the armature. Simple parallel rail launchers of the prior art have used rectangular cross section projectile launching rails and designs have been proposed wherein the bore is circular and the rails are then essentially formed from annular sectors. Additional rail configurations improvements have been shown in commonly assigned copending application Ser. No. 571,609, filed Jan. 17, 1984 and entitled "Electromagnetic Launchers With Improved Rail Configurations". Application Ser. No. 571,609 provides additional background information and is hereby incorporated by reference.

SUMMARY OF THE INVENTION

The present invention includes internally augmented, multiple projectile rail pair launchers wherein significant acceleration improvements are attained by reducing the stacked rail height toward the muzzle end. These launchers include at least two pairs of generally parallel conductive rails lining a bore and means for conducting current between each rail pair and for propelling a projectile along the rails. The total stacked height of the surfaces of each of the rails which lie adjacent to the bore decreases from the breech end to the muzzle end of the rails, thereby increasing the acceleration force on the projectile, caused by current flowing through each of the rails and through the means for conducting current between the rails, as the means for conducting current travels from the breech end to the muzzle end of the rails.

In one configuration, a separate current source is provided for each pair of rails and switching means is included for substantially simultaneously connecting each current source to its respective pair of rails. In an alternative configuration, the rails are electrically connected in series and a single current source is used to provide the propelling current.

DESCRIPTION OF THE PREFERRED EMBODIMENTS

Figure 1:
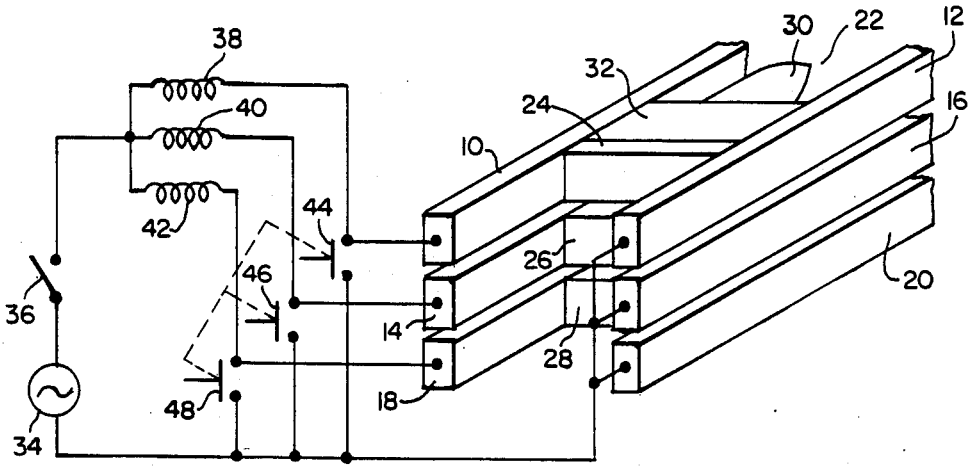
FIG. 1 is a schematic diagram of an electromagnetic projectile launching system constructed in accordance with one embodiment of the present invention.

Referring to the drawings, FIG. 1 is a schematic diagram of an internally augmented, multiple rail electromagnetic projectile launcher constructed in accordance with one embodiment of the present invention. This launcher includes a first pair of rails 10 and 12, a second pair of rails 14 and 16 and a third pair of rails 18 and 20 all lining a bore 22. A plurality of sliding metallic conductive armatures 24, 26 and 28 are positioned to make sliding electrical contact between the rails of the first, second and third pairs respectively, and serve as means for conducting current between the rails and for propelling projectile 30 along the rails. These conductive armatures are attached to an insulating sabot structure 32 which provides mechanical support for the armatures and the projectile.

A separate current source is provided for each pair of rails. This current source includes the series connection of a generator 34, which may be for example a homopolar pulse generator, a switch 36 and one of several inductive energy storage devices 38, 40 and 42. Switches 44, 46 and 48 serve as means for switching current from the current sources to the projectile launching rail pairs. These switches are shown to be ganged for substantially simultaneous operation.

Figure 2:
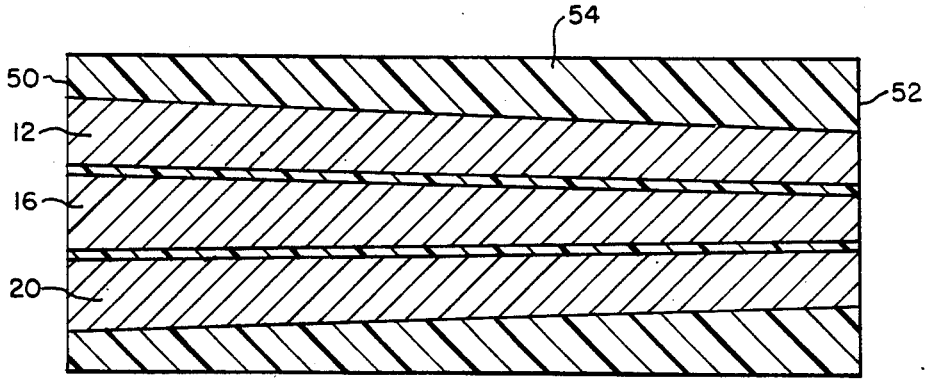
FIG. 2 is a cross-sectional view taken longitudinally through the projectile launching rails in a plane adjacent to the bore of one embodiment of the present invention.
Figure 3:
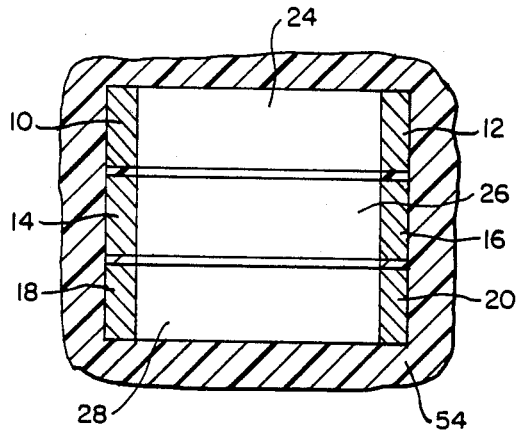
FIG. 3 is a transverse cross section of the launcher of FIG. 2 taken adjacent to the breech ends of the projectile launching rails.
Figure 4:
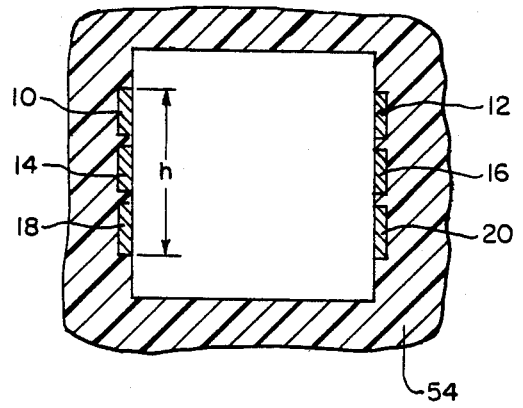
FIG. 4 is a transverse cross section of the launcher of FIG. 2 taken adjacent to the muzzle end of the rails.
Figure 5:
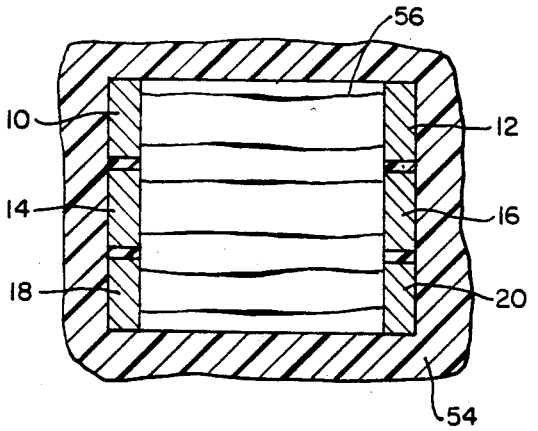
FIG. 5 is a transverse cross section of the launcher of FIG. 2 which illustrates a single plasma drive system.

FIG. 2 is a longitudinal cross section of a launcher of this invention taken in a plane adjacent to the launcher bore. This figure illustrates how the height of each launcher rail, and the total stacked height of the rails, decreases from the breech end 50 to the muzzle end 52 of the launcher bore. An insulating support structure 54 is provided to support the projectile launching rails and guide the projectile assembly. FIGS. 3 and 4 are transverse cross sections of the launcher of FIG. 2 taken adjacent to the breech and muzzle ends of the launcher respectively. These figures illustrate how the rectangular cross-sectional area of the rails may decrease toward the muzzle end and also how the total stacked height, h, of the rail surfaces which are adjacent to the bore decreases from the breech end to the muzzle end. Sliding conductive armatures 24, 26 and 28 are shown in FIG. 3 to extend between the rails of the first, second and third pairs respectively. If separate current sources are utilized for each conductive rail pair, electrical shorting of the rail pairs at the location of the armatures does not reduce the accelerating force on the projectile. Therefore, as illustrated in the transverse cross section of FIG. 5, a single plasma 56 or a single conductive armature spanning across all the rail pairs, can serve as a means for conducting current between the rails and for propelling the projectile along the rails. It should be noted that the multiple current sources of FIG. 1 are not entirely independent. In the design of ultra high current inductors, it is standard practice to obtain the high current capability by using a multiplicity of parallel inductor windings, each of which conducts the same current magnitude and all of which are generally interconnected electrically in parallel at the inductor terminals. The present invention takes advantage of this standard design by providing a firing switch which is electrically connected in series to each of the individual inductor winding circuits and across the breech end of each individual rail pair. These switches are ganged together so that the breech current is injected simultaneously from each inductor winding into each parallel projectile rail pair. It should be understood that the inductive energy store need not have a number of parallel windings that is precisely the same as the number of projectile rail pairs. For example, if an inductive energy store having eight windings were used in the launcher of FIG. 1, two windings would be left open-circuited and three sets of two windings each would be individually connected in parallel or series to feed current into each switch and projectile rail pair. For the series connection of two inductor windings feeding each rail pair and switch, a favorable configuration would have the two inductors connected on opposite sides of each firing switch.

The placement of individual firing switches into individual inductor circuits is not as complicated as it may at first glance appear since at ultra high currents, had there only been a single massive switch for a simple parallel rail launcher, a multiplicity of parallel conductors or bus bars would still most likely be required to conduct the firing current which may be for example 1.5 megamperes. The launcher of FIG. 1 simply keeps these parallel conductors electrically insulated from each other with each, or each set, now feeding into an individual firing switch. Because all current sources, rails and switches are in essence identical and in a geometrically and electrically parallel array, voltage differences between adjacent bus bars, rails or switches, will be minor and due to these low voltage differences there will be no insulation problems. Furthermore, with each firing switch subjected to only a fraction of the total current, for example one third in FIG. 1, the likelihood of switch damage due to arcing and current concentration effects during switching transients will be far reduced.

The electrical connection of FIG. 1 which involves separate and parallel inductor windings for providing current to a parallel array of projectile rail pairs allows shorting at, for example, the armature without a reduction in armature acceleration force. Thus the armature need not have a multiplicity of separate current paths. This allows for a simpler armature construction and of course readily permits plasma drive. During a projectile launch, the magnitude of the driving current will decrease as the projectile travels toward the muzzle. Since the integrity of the individual current paths across the armature need not be preserved, the total stacked height of the parallel rail pairs can now be reduced as allowed by the driving current reduction and reduced current residence time toward the muzzle. Thus, no matter how many parallel projectile rail pairs are used in a given launcher, their total stacked height can now be reduced commensurate with the driving current reduction experienced as the armature approaches the muzzle, and the full benefits of projectile rail height reduction will be attained for any number of projectile rail pairs.

Figure 6:
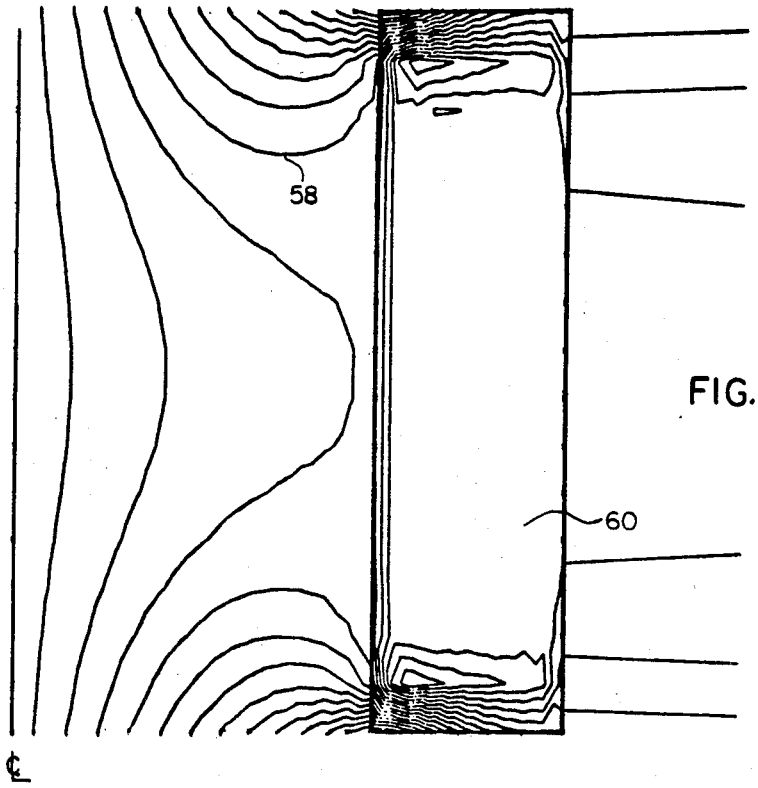
FIG. 6 is a computer generated plot of the magnetic flux distribution about one rail of a parallel rail launcher.

Another and more subtle projectile acceleration improvement will result from the physically and electrically in parallel connection of multiple projectile rail pairs, compared to using a single massive parallel rail pair launcher configuration. During a projectile launch, current tends to excessively concentrate toward the extremities of the projectile rails as illustrated by the computer generated plot in FIG. 6. That figure approximates the magnetic field distribution 58 just behind the projectile for copper launch rails 13 millimeters wide by 50 millimeters tall with a sliding armature having a velocity in the order of one thousand meters per second. FIG. 6 was created by an eddy current solution of a finite element program to show this current concentration effect graphically. The effect would be more pronounced for even higher armature velocities and thus results in greater current concentration and heating at the corners of the sliding armature contact.

Excessive current concentration toward the rail extremities adversely affects the inductance gradient L', which is always increased by having more current concentration toward the horizontal bore center line. The inductance gradient for a simple parallel rail launcher having a single parallel rail pair, with rail 60 being one of the rails, in the high velocity regime, will only be an estimated 0.389 microhenries per meter which is 19% below the inductance gradient of 0.478 microhenries per meter for an evenly distributed current. Thus another acceleration improvement inherent in the parallel connections of FIG. 1 is the decrease in acceleration reducing current concentrations in the projectile rails. Additionally, by forcing a more uniform current distribution in the stacked projectile rails and the armature, damage and wear due to excessive current concentration in both the rails and armature conductors and in the armature contact areas will be beneficially reduced. Furthermore, by having more uniform current flow across the armature, the armature acceleration force will be more uniform over the bore area thereby simplifying the armature and sabot structural design.

From the discussion up to this point, it should be understood that using the individual windings of a single inductive energy store, in such a manner that each winding or set of windings feeds a firing switch which injects current into an individual rail pair of a multiple rail pair launcher, presents no significant increase in complexity over using a single set of massive rails subjected to the total accelerating current. The beneficial effects of the parallel rail pair configuration are that a more uniform current density in the rails and armatures will yield a higher acceleration force, and less wear and less heating, than would be induced by excessive local current densities if the rails were undivided. Another advantage of the FIG. 1 configuration is that the inductors will force substantially equal current flow through each firing switch, which will improve switching performance. Additionally, the advantage of modularity is attained. For example, if one has a firing switch suitable for 0.5 MA, then a 2.0 MA launcher can use four parallel rail pairs, making it unnecessary to go to the expense of having to develop a 2.0 MA switch.

Figure 7:
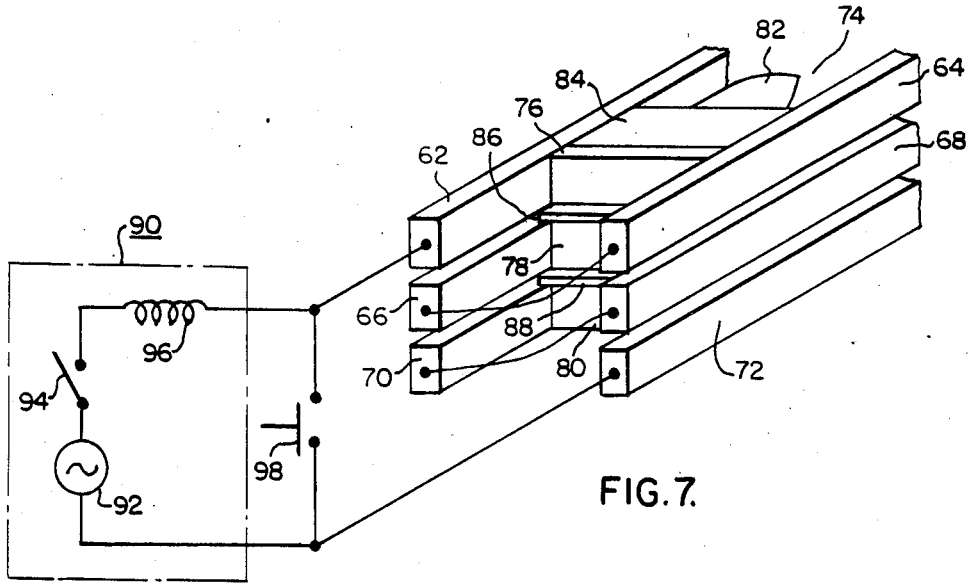
FIG. 7 is a schematic diagram of an alternative embodiment of the present invention.

FIG. 7 is a schematic diagram of an alternative embodiment of the present invention. In this embodiment, a first pair of rails 62 and 64, a second pair of rails 66 and 68 and a third pair of rails 70 and 72 are all positioned generally parallel to each other along the bore 74. Sliding conductive armatures 76, 78 and 80 serve as means for conducting current between the first, second and third rail pairs respectively and for propelling a projectile 82 along the rails. An insulating sabot structure 84 serves to support the armatures and projectile and includes insulating tabs 86 and 88 which prevent shorting between the armatures. Similar sabot structures are disclosed in the previously discussed commonly assigned U.S. Pat. No. 4,485,720. The rail pairs of FIG. 7 are electrically connected in series with each other and in series with a current source 90 which may comprise the series connection of a generator 92, switch 94 and inductor 96. A switch 98 serves as means for switching current from the current source 90 to the breech of the series connected projectile launcher rails. If a simple parallel rail launcher, that is one containing a single pair of launcher rails, is assumed to have the same bore area and rail cross section as the launcher of FIG. 7, then the simple parallel rail launcher design will have an accelerating force equal to $$F_1 = \tfrac{1}{2} L'_1 I^2_1 \tag{1}$$

where $I_1$ is the total current which is assumed to be uniformly distributed over the rail cross-sectional areas, and $L'_1$ is the inductance gradient for such a simple parallel rail launcher design, which will be about 0.5 microhenries per meter. To develop the same acceleration force $F_2$ in the series augmented launcher of FIG. 7, neglecting the minor inter-rail insulation area, the current density in the FIG. 7 rails will have to be precisely that of the simple parallel rail launcher, since the force on the armature is only a function of the vector cross product of the current density and the magnetic field density. To therefore get the same force, the current in the launcher rails of FIG. 7, $I_2$ will have to be equal to $\frac{1}{3}I_1$ and:

$$F_2 = \tfrac{1}{2} L'_2 I^2_2 = \tfrac{1}{2} L'_2 (\tfrac{1}{3} I_1)^2 = \tfrac{1}{2} L'_1 I^2_1 \tag{2}$$

and hence:

$$L'_2 = 9L'_1 = N^2 L'_1 \tag{3}$$

where N equals the number of series connected rail pairs for equivalent rail cross-sectional area designs. This simply demonstrates that an internally augmented series connected parallel rail launcher exhibits force augmentation by about a factor of $N^2$ for a fixed current. It should also be understood, that for the same force, rail current densities will be identical for a simple parallel rail launcher and internally series augmented versions.

When the launcher of FIG. 7 is operated at high velocities and high currents, high voltage differences, which can reach the order of a few kilovolts, may occur between adjacent rails and between the individual and distinct current paths or loops of the armature. This is why insulating tabs 86 and 88 are shown to be included on the sabot structure 84.

Figure 8:
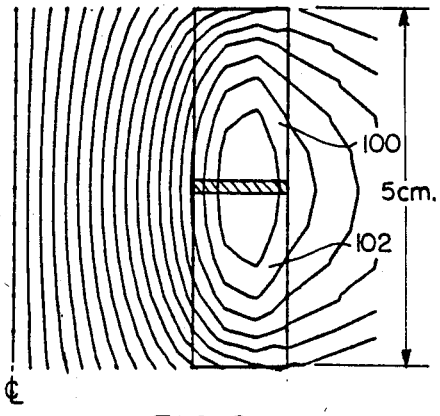
FIGS. 8 and 9 are computer generated plots of the magnetic flux produced by current flowing at the breech end and the muzzle end respectively of a pair of launcher rails which may be used in the launchers of this invention.
Figure 9:
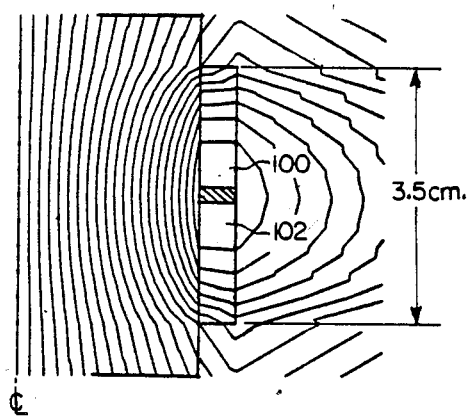

The computer generated magnetic flux distributions of FIGS. 8 and 9 can now be used to illustrate the force augmentation provided for internally augmented launcher configurations. If a simple parallel rail launcher, having a single pair of launcher rails, has a 50×50 millimeter bore and a 50×13 millimeter rail cross section, it will have a calculated inductance gradient $L'_S$ of 0.478 microhenries per meter for a uniform current distribution. By using two pairs of series connected rails as shown in FIG. 8 wherein rails 100 and 102 represent one rail of each of the series connected pairs, and neglecting the very minor effect of the inter-rail pair insulation, one obtains a four fold increase in the inductance gradient L' since the inductance gradient is proportional to the number of turns squared. In that case, the configuration of FIG. 8 results in an inductance gradient $L'_A$ equal to 1.912 microhenries per meter for a uniform current distribution in the rails.

FIG. 9 illustrates the magnetic flux distribution toward the muzzle end of the launcher. Assuming a muzzle current reduction of 30%, the conducting rail height or perimeter is therefore allowed to be reduced by at least 30% and in the FIG. 9 flux plot it has been additionally assumed that the current penetration in the wake of the now more rapidly moving projectile averages only 5 millimeters. For a simple parallel rail launcher having the same dimensions as the bore of the launcher of FIG. 9, the inductance gradient would be 0.592 microhenries per meter. By using the internally augmented configuration of FIG. 9, the inductance gradient is increased four-fold to 2.368 microhenries per meter. Thus by internal series augmentation and rail height reduction toward the muzzle, a four fold force augmentation at the breech has been achieved compared to a simple parallel rail launcher at the same current level. Toward the muzzle, in comparison to the breech of a simple launcher, the force augmentation is now a factor of 4.95, or an additional 24% improvement. More precisely, 18% is due strictly to rail height reduction and the rest is due to reduced current penetration into the rail thickness.

The two rail pair internally series augmented configuration is particularly attractive since there are only two conducting paths across the armature which must be insulated from each other. However, if an additional rail pair is added while maintaining the same rail and bore area, an additional force factor of only 2.25 (9 divided by 4) is achieved. Furthermore, since the central rail pair height must remain substantially unchanged as the location of the inter-rail insulation must remain fixed in order to maintain the separate current paths in the armature, a 30% rail height reduction justified by current reduction, can now effectively only be applied to the other rail pairs and hence the overall rail height reduction will not be 30%, but instead only around 20%. Therefore there is less enhancement of acceleration force available toward the muzzle end.

If the rail configuration illustrated in FIGS. 8 and 9 is supplied by a pair of parallel current sources and because the inductances in the two rail pairs are substantially identical, the voltage differences across the insulation between the adjacent rail pairs will be zero. For a three projectile rail pair launcher, this is not quite the case since the middle projectile rail pair will have a somewhat higher inductance and hence due to the inductive voltage component and differences in energy consumption, there will be voltage differences in the order of tens of volts across the insulation between adjacent rails. For a larger number of rail pairs in a parallel array, transposition can be used advantageously to assure that energy flow to each rail pair is closely matched. For example, with four stacked projectile rail pairs, one inductor circuit can provide the current to the upper left rail and the second from the top on the right. By similar criss-crossing rail pairs, all four will have the same inductance, energy flow to them will be better matched, and voltage differences across insulators will be reduced. Obviously, this transposition is only feasible when the now transposed projectile rail pairs are all shorted at the armature or plasma, or if the armature has distinct criss-crossed current paths to interconnect across the transposed projectile rails.

Figure 10:
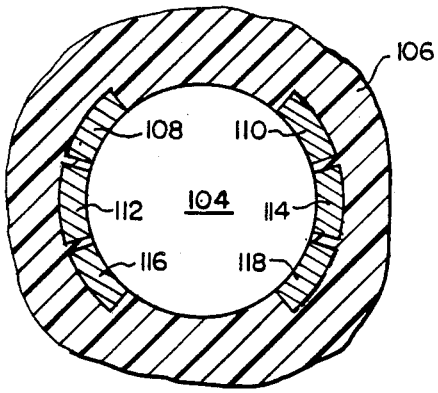
FIGS. 10 and 11 are transverse cross sections of an alternative embodiment of the present invention, taken near the breech and muzzle ends of the launcher bore.
Figure 11:
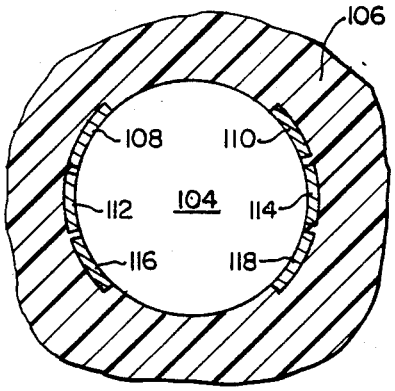

FIGS. 10 and 11 are transverse cross sections of a circular bore launcher constructed in accordance with the invention. Bore 104 in support structure 106 is lined by three pairs of projectile launching rails 108 and 110, 112 and 114, and 116 and 118. FIG. 10 is taken near the breech end and FIG. 11 is taken near the muzzle end. Note that the portion of the bore circumference spanned by the rails and, if desired, the width of the rails decreases from the breech end to the muzzle end in a manner similar to that illustrated in FIG. 2.

Although the present invention has been described in terms of what are at present believed to be its preferred embodiments, it will be apparent to those skilled in the art that various changed may be made without departing from the scope of the invention. It is therefore intended that the appended claims cover all such changes.

What is claimed is:

1. An electromagnetic projectile launcher comprising:

four generally parallel conductive rails lining a bore;

first and second sources of electric current;

means for conducting current between a first pair of said rails and between a second pair of said rails, and for propelling a projectile along said rails;

means for substantially simultaneously connecting said first current source to a first end of said first pair of rails and for connecting said second current source to a first end of said second pair of rails; and wherein the total stacked height of said rails adjacent to said bore decreases from said first ends of said rails to a second end of said rails, thereby for a given current, increasing acceleration force on said projectile, caused by current flowing through said rails and through said means for conducting current, as said means for conducting current travels from said first ends to said second ends of said rails.

2. An electromagnetic projectile launcher as recited in claim 1, further comprising:

an additional pair of conductive rails lining said bore and lying generally parallel to said four conductive rails;

a third source of electric current;

means for conducting current between said additional pair of rails for propelling said projectile along said additional pair of rails;

means for connecting said third current source to a first end of said additional pair of rails, substantially simultaneously with the connection of the first two current sources to the first and second pairs of said four conductive rails; and wherein the total stacked height of said first, second and additional pairs of rails adjacent to said bore decreases from said first end of said first, second and additional pairs of rails to a second end of each pair of rails, thereby increasing for a given current, the acceleration force on said projectile caused by current flowing through said pairs of rails and through said means for conducting current between said pairs of rails, as said means for conducting current between said pairs of rails travels from said first ends to said second ends of said pairs of rails.

3. An electromagnetic projectile launcher as recited in claim 1, wherein said first and second sources of electric current comprise:

a single electrical generator; and wherein each of said current sources includes a separate winding of an induction coil, each of said windings being electrically connected to said electrical generator.

4. An electromagnetic projectile launcher as recited in claim 1, wherein said means for substantially simultaneously connecting said first and second current sources to said first and second pairs of rails, respectively, comprises:

a first switch electrically connected in series with said first current source and across said first pair of rails; and a second switch electrically connected in series with said second current source and across said second pair of rails;

wherein said first and second switches are ganged for substantially simultaneous operation.

5. An electromagnetic projectile launcher as recited in claim 1, wherein said means for conducting current between said first pair of rails and between said second pair of rails comprises a single plasma.

6. An electromagnetic projectile launcher as recited in claim 1, wherein said means for conducting current between said first pair of rails and between said second pair of rails comprises:

a first metallic armature in sliding electrical contact with said first pair of rails; and a second metallic armature in sliding electrical contact with said second pair of rails.

7. An electromagnetic projectile launcher as recited in claim 1, wherein the cross-sectional area of each of said rails decreases from said first ends of said rails to said second ends of said rails.

8. An electromagnetic projectile launcher comprising:

four generally parallel conductive rails each having an arcuate surface lining a bore;

first and second sources of electric current;

means for conducting current between a first pair of said rails and between a second pair of said rails, and for propelling a projectile along said rails;

means for substantially simultaneously connecting said first current source to a first end of said first pair of rails and for connecting said second current source to a first end of said second pair of rails; and wherein the portion of the circumference of said bore spanned by said rails decreases from said first ends of said rails to a second end of said rails, thereby for a given current, increasing acceleration force on said projectile, caused by current flowing through said rails and through said means for conducting current, as said means for conducting current travels from said first ends to said second ends of said rails.

9. A method of improving uniformity of current distribution in the rails of a parallel rail electromagnetic launcher, said method comprising the steps of:

switching current from a first current source to a first end of a first pair of generally parallel projectile launching rails, having decreasing height from said first end to a second end thereof, wherein said first current source includes the series connection of a generator and a first winding of an inductor;

substantially simultaneously switching current from a second current source to a first end of a second pair of generally parallel projectile launching rails, having decreasing height from said first end to a second end thereof, wherein said second current source includes the series connection of said generator and a second winding of said inductor; and conducting current between said first pair of rails and between said second pair of rails through a conducting means which moves along said rails.

* * * * *